US005749129A

United States Patent [19]

Murasaki et al.

[11] Patent Number: 5,749,129

[45] Date of Patent: May 12, 1998

[54] MOLDED SURFACE FASTENER, AND METHOD AND APPARATUS FOR MANUFACTURING THE SAME

[75] Inventors: Ryuichi Murasaki; Toshiaki Takizawa; Mitsuru Akeno; Keisuke Sakakibara; Tsuyoshi Minato, all of Toyama-ken, Japan

[73] Assignee: YKK Corporation, Tokyo, Japan

[21] Appl. No.: 743,663

[22] Filed: Nov. 5, 1996

[30] Foreign Application Priority Data

Nov. 6, 1995 [JP] Japan ..... 7-287583

[51] Int. Cl.[6] ..... A44B 18/00

[52] U.S. Cl. ..... 24/452; 24/442; 24/446; 24/450

[58] Field of Search ..... 24/452, 451, 450, 24/449, 448, 447, 446, 445, 444, 443, 442

[56] References Cited

U.S. PATENT DOCUMENTS 3,762,000 10/1973 Menzin et al. ..... 24/452
4,846,815 7/1989 Scripps ..... 24/442
5,067,210 11/1991 Kayaki ..... 24/452
5,077,870 1/1992 Melbye et al. ..... 24/452

*Primary Examiner*—Victor N. Sakran
*Attorney, Agent, or Firm*—Hill, Steadman & Simpson

[57] ABSTRACT

A molded surface fastener is manufactured by supplying molten resin to the circumferential surface of a die wheel rotating in one way to mold a substrate sheet blank and a multiplicity of substantially straight and inclined engaging element blanks in an integral form, and then pressing distal ends of the engaging element blanks by a heat-molding roller in rotation at the same speed to incline the engaging element blanks further toward the substrate sheet blank and also to melt the distal ends to shape each said distal end into an engaging head projecting in a direction opposite to the direction of inclination of the respective engaging element blank. Each of the resulting engaging elements is composed of a stem rising from the substrate sheet surface with inclination by a predetermined angle (θ1), and an engaging head projecting from an upper end of the stem in a direction opposite to the direction of inclination of the stem, an extension line of the engaging head crossing the substrate sheet surface at a predetermined acute angle (θ2).

5 Claims, 6 Drawing Sheets

MOLDED SURFACE FASTENER, AND METHOD AND APPARATUS FOR MANUFACTURING THE SAME

BACKGROUND OF THE INVENTION

1. Field of the Invention

This invention relates to a surface fastener integrally molded continuously of thermoplastic resin by continuous injection or extrusion and composed of a substrate sheet and a multiplicity of engaging elements standing on a front surface of the substrate sheet, and a method and apparatus for continuously manufacturing the molded surface fastener. More particularly the invention relates to a molded surface fastener having a unique shape and excellent in engaging rate and engaging strength, and a method and apparatus for continuously manufacturing the molded surface fastener.

2. Description of the Related Art

Conventionally, an engaging member in which female surface fastener having a multiplicity of loops on the front surface of a substrate sheet, and male surface fasteners having on the front surface of a substrate sheet a multiplicity of engaging elements engageable with the loops are engaged by pressing, are already known. In recent years, application of such surface fasteners is on the increase from connectors for daily goods to connectors for various kinds of industrial materials.

Although the surface fastener having a multiplicity of loops on the front surface of a substrate sheet is yet made of woven or knit fabric or non-woven cloth obtained by weaving or knitting fiber threads with no large variation as compared to the conventional surface fastener, attempts have been made to improve engaging elements of the surface fastener in order to cope with the above-mentioned various uses, and at the same time, considerations have been made also with respect to the cost of production.

Further, the use of the above-mentioned surface fasteners is on the rise also for underwear such as diaper; therefore, the engaging elements for this use are required to have adequate engaging strength, adequate softness and less itchy touch. For this purpose, it is additionally cherished that the size of the engaging elements are reduced to a minimum. Especially since disposable daily goods such as paper diaper should be inexpensive, fiber woven or knit surface fasteners tend to be avoided to lower the price as much as possible.

On the other hand, the shapes of the conventional engaging elements are chiefly divided into three shapes: the hook-shape engaging element having a hook-shape engaging head curving in an arc downwardly from the upper end of a stem standing on the front surface of the substrate sheet; the so-called mushroom-shape engaging element having an umbrella-shape engaging head bulging in all directions and upwardly from the upper end of a stem standing on the front surface of the substrate sheet; and the palm-tree-shape engaging element having a palm-tree-shape hook engaging head projecting from the upper end of a stem standing on the front surface of the substrate sheet. Of course, various modifications have been suggested to improve these three types of engaging elements individually.

These three types of engaging elements are remarkably different in engaging characteristic from one another as follows. The hook-shape engaging head of the hook-shape engaging element tends to deform and catches a companion loop almost at the same position, while the umbrella-shape engaging head of the mushroom-shape engaging element is hard to deform and is engaged by a plurality of companion loops crosswise in various directions. Therefore, the hook-shape engaging element has generally less engaging strength than the mushroom-shaped engaging element. However, the mushroom-shaped engaging element tends to be encountered with a so-called hanging phenomenon and also tends to damage itself or the companion loops during repeated use, thus it is disadvantageous in this respect as compared to the hook-shape engaging element. Regarding the rate of engagement with the companion loops, the mushroom-shape engaging element is superior to the hook-shape engaging element since the mushroom-shape engaging element can engage in any direction, and is easier to engage small loops. In the meantime, the engaging characteristic of the palm-tree-shape engaging element may be described as a compromise between that of the mushroom-shaped engaging element and that of the hook-shape engaging element.

For the above-mentioned reasons, surface fasteners having mushroom-shape engaging elements are increasingly used as fasteners for industrial materials, interior ornaments and daily goods, which require adequate engaging strength and are used relatively less repeatedly. This mushroom-type surface fastener is exemplified by woven or knit fiber surface fastener disclosed in, for example, U.S. Pat. Nos. 3,191,255 and 4,846,815 and a molded synthetic resin surface fastener disclosed in, for example, U.S. Pat. Nos. 3,718,725 and 5,077,870 and International Publication No. WO94/23610.

A compromise engaging element between the hook-shape engaging element and the mushroom-shape engaging element is disclosed in Japanese Patent Publication No. Sho 63-66524. According to this Publication, the engaging element is made of monofilament composed of monofilamentary stem standing in an inclined posture or a substantially upright posture from the knit cloth surface, and a substantially egg-shape engaging head integral with and projecting from the stem horizontally or diagonally upwardly. The engaging characteristic of this surface fastener is a compromise between the hook-type fiber surface fastener and the mushroom-type fiber surface fastener. Namely, this surface fastener is easy to peel like the hook-type surface fastener and has adequate engaging strength like the mushroom-type surface fastener and can secure adequate resistance against repeated use.

The fiber surface fastener disclosed in, for example, U.S. Pat. Nos. 3,191,255 and 4,846,815 has adequate softness because of its substance. However, this fiber surface fastener requires many processing steps, which is low in productivity and high in cost.

The surface fastener disclosed in Japanese Patent Publication No. Sho 63-66524 is composed of a fiber knit cloth like the foregoing surface fasteners, and it has also poor productivity and it has limit in lowering of its price. Further, since the egg-shape engaging head formed at an upper end of the engaging element of the surface fastener extends in parallel to the substrate cloth surface or a tip end of the engaging head faces diagonally upwardly, the stem is inclined further in the direction of its inclination when the surface fastener is pressed by the companion surface fastener. Therefore, most of the engaging heads face diagonally upwardly and as a result, a predetermined rate of engagement is hard to achieve. Also upon completion of engagement with the companion loops, the engaging element is less resistant against separation and can hence be separated very easily since the engaging element is made of monofilament so that they are too flexible and the engaging head has the above-described shape.

On the other hand, the molded synthetic resin surface fastener disclosed in, for example, U.S. Pat. Nos. 3,718,725 and 5,077,870 and International Publication No. WO94/23610 can be efficiently manufactured by a continuous process and is therefore low in price. Generally, however, this type surface fastener is large in rigidness and inevitably gives a hard touch, particularly a very itchy touch when the upper end of the engaging element comes into contact with the user's skin. Therefore the surface fasteners of this conventional type are not suitable for daily goods such as underwear, and they are used mostly as connectors for industrial materials.

SUMMARY OF THE INVENTION

A first object of this invention is to provide a molded synthetic resin surface fastener which can secure high productivity and low price and also secure a high degree of flexibility and engaging strength as compared to those of hook-shape engaging elements in a conventional molded surface fastener, can prevent occurrence of a so-called hanging phenomenon without the risk of impairing an adequate degree of engagement with companion loops, can secure an appropriate degree of resistance against separation from the loops and is less in itchy touch as compared to the conventional hook-shape engaging elements.

A second object of the invention is to provide a method of continuously manufacturing the above-mentioned molded synthetic resin.

A third object of the invention is to provide an apparatus for carrying out the above-mentioned method.

According to a first aspect of the invention, the above first object is accomplished by a surface fastener molded of synthetic resin, comprising: a substrate sheet and a multiplicity of engaging elements standing on a front surface of the substrate sheet. Each of the engaging elements is composed of a stem rising from the substrate sheet and inclined at a predetermined angle (θ1) with respect to the front surface, and an engaging head one end of which is integrally supported on an upper end of the stem and the other end of which extends in a direction opposite to the direction of inclination of the stem in such a manner that an extension line in a direction of extension of the engaging head crosses the front surface of the substrate sheet at a predetermined acute angle (θ2).

In the molded surface fastener, a plurality of engaging elements may be arranged in a plurality of rows on the front surface of the substrate sheet, the stems of the engaging elements of each row being inclined in a common direction, the engaging heads of the engaging elements of each row extending in a common direction. Alternatively, the stems of each adjacent pair of rows may be inclined in opposite directions, and the engaging heads of each pair of rows also may be inclined in opposite directions. In another alternative form, the stems of each adjacent pair of the engaging elements of each row are inclined in opposite directions, and the engaging heads of each adjacent pair of the engaging elements of each row may be inclined in opposite directions.

According to a second aspect of the invention, the above first object is accomplished by a surface fastener molded of synthetic resin, comprising: a substrate sheet and a multiplicity of engaging elements standing on a front surface of the substrate sheet. A pair of the engaging elements stand in a generally V- or Y-shape and each of which is composed of a stem rising from the substrate sheet at a predetermined angle (θ1) with respect to the front surface, and an engaging head one end of which is integrally supported on an upper end of the stem and the other end of which extends in a direction opposite to inclination of the stem, the engaging heads of the pair of engaging elements extending toward each other, and an extension line of respective engaging head crosses the front surface of the substrate sheet at a predetermined acute angle (θ2).

When the molded surface fastener is pressed by a companion surface fastener having a multiplicity of loops on the front surface of a substrate sheet, the stem of each engaging element is inclined further in the direction of its inclination so that the companion loop is guided over the stem. Then, when the pressure by the companion surface fastener is released, the stem resiliently stands up so as to catch the loop between the stem and the engaging head. At that time, since the engaging head has an acute angle with respect to the substrate sheet, the caught loop is reliably retained in engagement with the engaging head.

When a pulling force in a direction of separation acts on the caught loop, the engaging head, unlike the conventional hook-shape engaging element, does not resiliently deform to keep the retaining force and, at the same time, does act on the upper end of the stem as a stand-up force so that the upper end of the stem would resiliently deform in a direction opposite to the direction of inclination to direct the chin of the engaging head diagonally upwardly, whereupon the loop is removed off the engaging head easily. Also in the case where plural loops are in engagement with the same engaging head, since the rear end of the engaging head is supported by the upper end of the stem, the loops would not remain engaged with the rear end of the engaging head during separation, namely, would not assume a hanging posture so that the loops can separate smoothly from the engaging head.

According to a third aspect of the invention, the above second object is accomplished by a method of continuously manufacturing a synthetic resin molded surface fastener having a multiplicity of engaging elements standing on a substrate sheet, the method comprising the steps of: rotating a die wheel having in its circumferential surface a multiplicity of substantially straight engaging-element-primary-forming cavities inclined at a predetermined angle with respect to a radial direction; continuously supplying molten resin to a molten resin introduction port of the die wheel under a predetermined resin pressure; molding a substrate sheet blank and a multiplicity of engaging element blanks in an integral form along the rotation of the die wheel while the engaging-element-forming cavities are filled with the molten resin; separating the molded substrate sheet blank and engaging element blanks from the circumferential surface of the die wheel and moving the separated blanks in a traveling path; and while moving the separated substrate sheet blank and engaging element blanks in the traveling path, pressing distal ends of the engaging element blanks by a heat-molding roller to incline the engaging element blanks further in the direction of the inclination and also to melt the distal ends to shape each the distal end into an engaging head projecting in a direction opposite to the direction of inclination of the respective engaging element blank.

Preferably, the molten resin is injected to the molten resin introduction port of the die wheel directly from a continuous injection nozzle disposed in confronting relation to the circumferential surface of the die wheel, or the molten resin is extruded from an extrusion nozzle toward the molten resin introduction port bounding between the die wheel and a pressure roller parallel to an axis of the die wheel.

According to a fourth aspect of the invention, the above third object is accomplished by an apparatus for continuously manufacturing a synthetic resin molded surface fastener having a multiplicity of engaging elements standing on a front surface of a substrate sheet, the apparatus comprising: a die wheel having on its circumferential surface a multiplicity of substantially straight engaging-element-primary-forming cavities inclined at a predetermined angle with respect to a radial direction; a drive source for driving the die wheel to rotate in one direction; molten resin supply means disposed to face the molten resin introduction port of the die wheel and having inside a predetermined width of sprue; separating means for continuously separating a surface fastener molded on the circumferential surface of the die wheel off the circumferential surface of the die wheel along the rotation of the die wheel; moving means for moving the separated surface fastener in a predetermined traveling path; and a heat-molding roller disposed on the traveling path in confronting relation to engaging element blanks of the surface fastener for pressing distal ends of the engaging element blanks downwardly and driven to rotate in a direction of the moving in synchronism with a moving speed of the surface fastener so as to melt the distal ends heated to a melting temperature of the resin material to shape each distal end into an engaging head projecting in a direction opposite to the direction of inclination of the respective engaging element blank. The die wheel usually has cooling means.

Preferably, the molten resin supply means is a continuous injection nozzle disposed in confronting relation to the circumferential surface of the die wheel. Alternatively, the apparatus may further include a pressure roller parallel in axis to the die wheel, and the molten resin supply means is an extrusion nozzle for extruding the molten resin toward the molten resin introduction port bounding between the die wheel and the pressure roller. For the V-shape or Y-shape engaging elements, it is preferably that the heat-molding roller has on its circumferential surface a circumferentially continuous zigzag pattern of bulged and recessed portions.

DETAILED DESCRIPTION OF THE PREFERRED EMBODIMENTS

Various preferred embodiment of this invention will now be described in detail with reference to the accompanying drawings.

Figure 1:
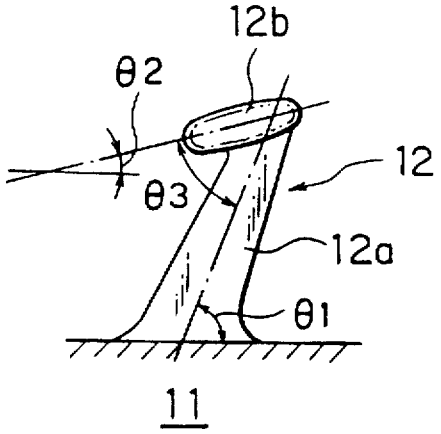
FIG. 1 is a side view showing an engaging element in a molded surface fastener according to this invention.
Figure 2:
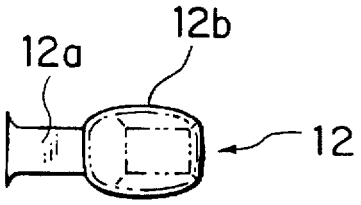
FIG. 2 is a plan view of the engaging element of FIG. 1.

FIG. 1 is a side view showing an engaging element of a molded synthetic resin surface fastener according to a typical embodiment of this invention, and FIG. 2 is a plan view of the engaging element. As shown in FIGS. 1 and 2, the engaging element of this embodiment has a very simple form. The synthetic resin to be used for the surface fastener of this invention is exemplified by thermoplastic resin, such as polyamide, polyester and polypropylene.

In FIGS. 1 and 2, reference numeral 11 is a substrate sheet molded of synthetic resin and having a front surface on which a multiplicity of engaging elements 12 (only one illustrated here) unique in shape stand integrally as being molded. Each engaging element 12 is composed of a stem 12*a* rising from the front surface of the substrate sheet 11 with inclination by a predetermined angle θ1 with respect to the front surface, and an engaging head 12*b* projecting from the upper end of the stem 12*a* in a direction opposite to the direction of inclination of the stem 12*a* and inclined by an acute angle θ2 with respect to the front surface of the substrate sheet 11.

The angle θ1 between the front surface of the substrate sheet 11 and the stem 12*a* is determined by the quality of the synthetic resin, and the cross-sectional shape, size and whole shape of the stem. If the quality of the synthetic resin is soft, it is required that the angle is as large as possible but less than 90° to secure an adequate degree of resiliency; if the cross-sectional shape of the stem diverges toward its base end as illustrated, the angle may be reduced near to 60°. The angle is determined based on the above-mentioned various factors.

The angle θ2 between the front surface of substrate sheet 11 and the engaging head 12*b* depends on the angle θ1 between the front surface of the substrate sheet 11 and the stem 12*a*. Specifically, at the crossing of the stem 12*a* and the engaging head 12*b*, its angle θ3 (=θ1−θ2) determines the degree of opening of a bosom in which the companion loop is to be engaged. If the angle θ3 is too small, it would be hard to engage the loop; consequently, for the angle θ3 to secure engagement with the loop, the optimum value is selected in relation to the angles θ1, θ2.

Figure 3A:
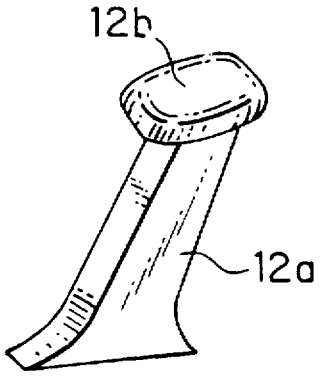
FIGS. 3(A), 3(B) and 3(C) are fragmentary perspective views showing examples of shape of an engaging head of the engaging element.
Figure 3B:
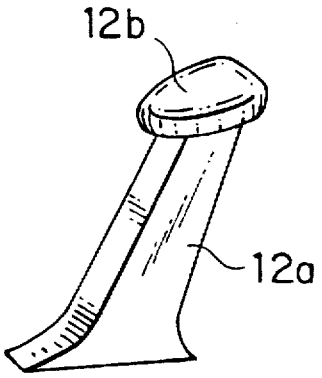
Figure 3C:
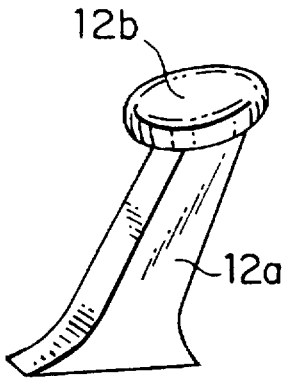
Figure 4A:
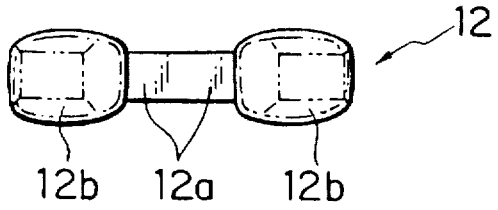
FIGS. 4(A) and 4(*b*) show a modified engaging element.
Figure 4B:
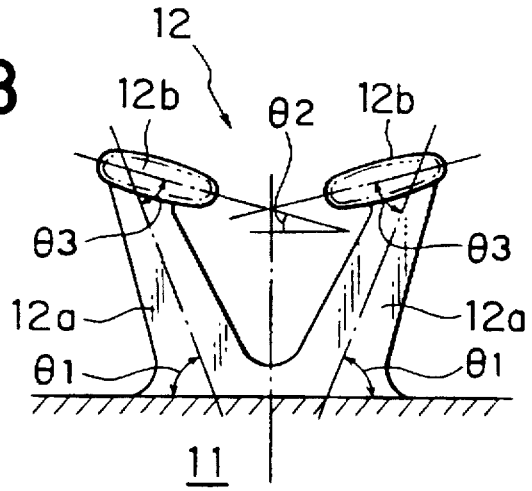
Figure 5A:
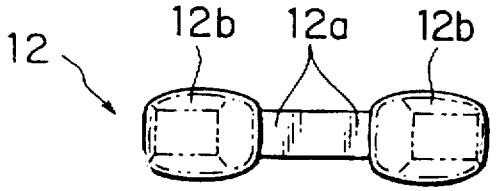
FIGS. 5(A) and 5(B) show another modified engaging element.
Figure 5B:
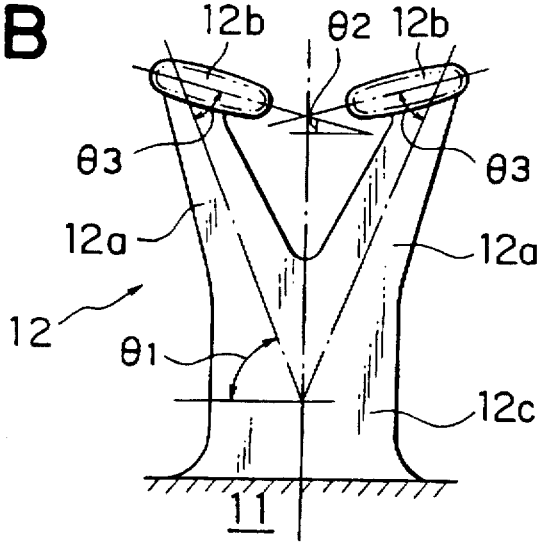

The shape of the engaging head 12*b* is not specifically limited and is generally exemplified by a flattened parallelepiped, a flattened spheroid and a triangular plate having a substantially oval cross section, as shown in FIGS. 3(A), 3(C) and 3(B). On the other hand, the shape of the stem 12*a* also is not limited to the illustrated example and various other shapes may be suggested. In the example of FIGS. 1 and 2, the cross-sectional shape of the stem 12*a* is a generally rectangle elongated longitudinally of the engaging head 12*b* with its long sides increasing gradually toward its base end. In alternative forms, circular, oval, triangular and other polygonal cross-sectional shapes may be suggested, and such cross-sectional shape being uniform in size from the base end to the upper end.

The engaging elements 12 are arranged in rows with the engaging heads 12*b* extend in a common direction and the multiplicity of rows are arranged to be disposed in width direction. Alternatively, the engaging heads of the engaging elements between each adjacent pair of rows may extend in opposite directions. In another alternative form, the engaging heads of each adjacent pair of engaging elements in the same row may extend in opposite directions.

When the engaging elements 12 of the molded surface fastener of this invention are pressed by a companion surface fastener having a multiplicity of loops on the front surface of a substrate sheet, the stem 12*a* of each engaging element 12 is inclined further in the direction of its inclination so that the companion loop is guided over the stem 12*a*. Then, when the pressure of the companion surface fastener is released, the stem 12*a* resiliently stands up so as to catch the loop in the opening between the stem 12*a* and the engaging head 12*b*. At that time, since the engaging head 12*b* extends at an acute angle θ2 with respect to the substrate sheet 11, the caught loop is retained reliably in engagement with the engaging head 12*b*.

When a pulling force in a direction of separation acts on the caught loop, the engaging head 12*b*, unlike the conventional hook-shape engaging element, does not resiliently deform to keep the retaining force and, at the same time, does act on the upper end of the stem 12*a* as a stand-up force so that the upper end of the stem 12*a* would resiliently deform in a direction opposite to the direction of inclination to direct the chin of the engaging head 12*b* diagonally upwardly, whereupon the loop is removed off the engaging head 12*b* easily. Also in the case where plural loops are in engagement with the same engaging head 12*b*, since the rear end of the engaging head 12*b* is supported by the upper end of the stem 12*a*, the loops would not remain engaged with the rear end of the engaging head 12*b* during separation, namely, would not assume a hanging posture so that the loops can separate smoothly from the engaging head 12*b*.

FIGS. 4(A), 4(B), 5(A) and 5(B) show modified engaging elements. A pair of engaging elements 12, 12 of these figures stand on the surface of the substrate sheet 11. In the modified example of FIGS. 4(A) and 4(B), the pair of engaging element 12, 12 share a common generally V-shape base and rise from the substrate sheet 11, and an engaging head 12*b* is formed at an upper end of the respective stem 12*a*. Each of the pair of engaging head 2*b* extends toward each other. Each engaging head 12*b* extends in a direction opposite to inclination of the corresponding branch at a predetermined acute angle θ2 with respect to the front surface of the substrate sheet 11. On the other hand, in the modified example of FIGS. 5(A) and 5(B), the pair of engaging element 12, 12 are provided like the example of FIGS. 4(A) and 4(B) but its base includes an upright base portion 12*c* standing upright from the substrate sheet 11 at a predetermined height at a predetermined angle θ1 with respect to the front surface, and a pair of stems 12*a*, 12*a* standing in a generally V-shape from the upright base portion 12*c*. And a pair of engaging heads 12*b*, 12*b* project from upper ends of the respective stem 12*a*, 12*a* toward each other, each engaging head 12*b* extending a direction opposite to inclination of the corresponding stem 12*a* at a predetermined acute angle θ2 with respect to the front surface of the substrate sheet 11. Therefore, the whole shape is a generally Y-shape.

Figure 6:
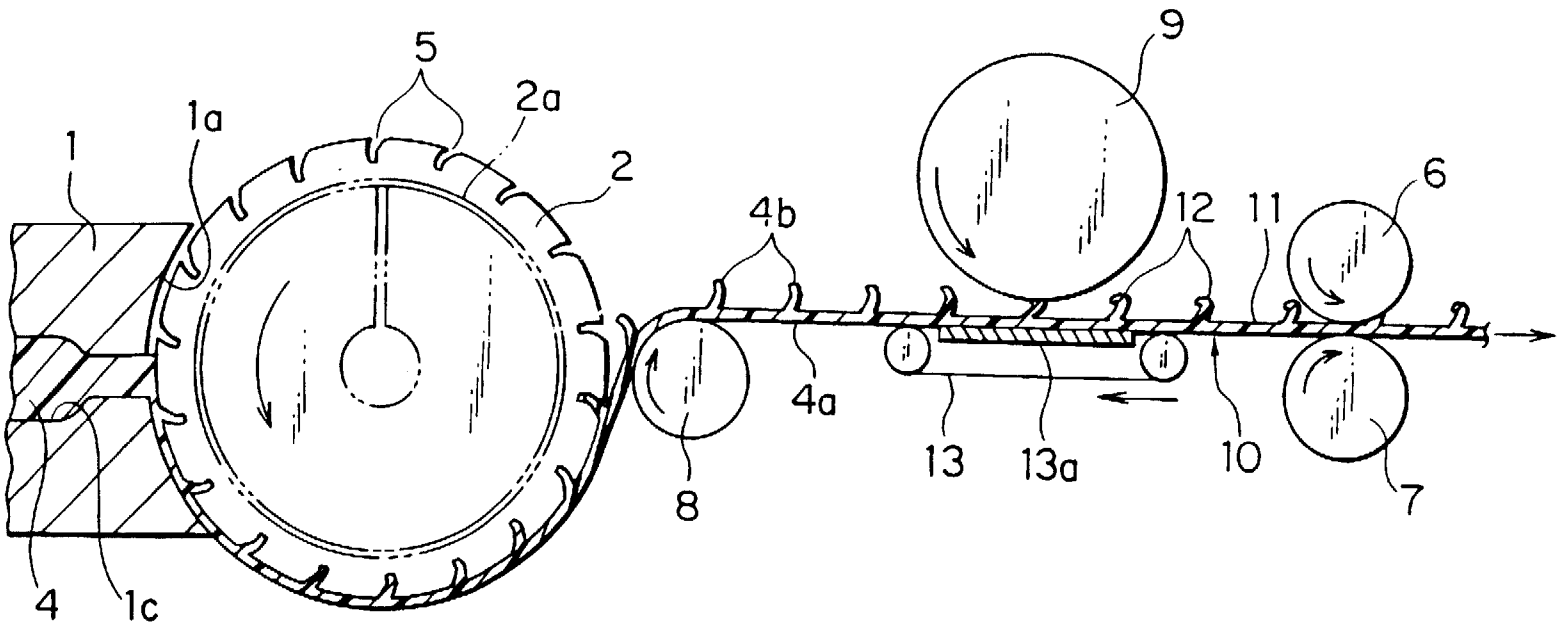
FIG. 6 is a fragmentary side view showing the process in which a molded surface fastener is manufactured according to a method of this invention.
Figures 7A, 7B, 7C:
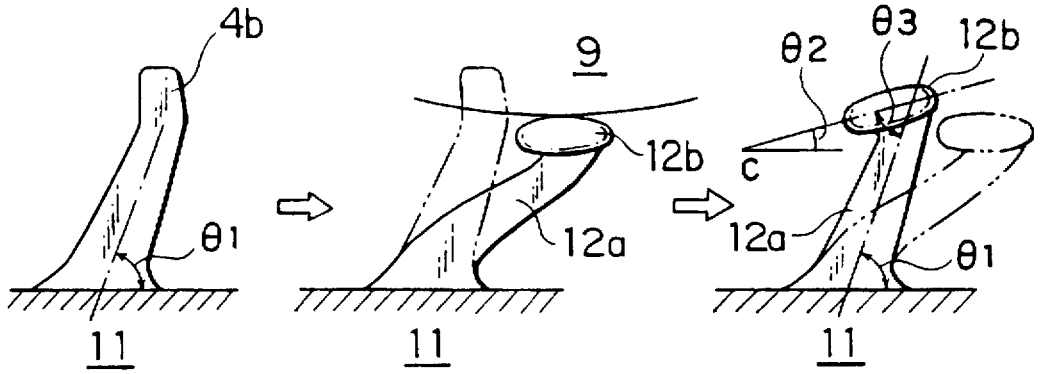
FIGS. 7(A), 7(B) and 7(C) show the manner in which the engaging head is formed in the method of this invention.

The molded surface fastener having the foregoing shape is continuously manufactured in the following method using an apparatus described below. FIG. 6 is a fragmentary side view showing a typical process in which the molded surface fastener is continuously manufactured on a typical apparatus, and FIGS. 7(A), 7(B) and 7(C) are side views showing the process in which the distal end of an engaging element blank is shaped into an engaging head by the apparatus.

In FIG. 6, reference numeral 1 designates an injection nozzle, whose tip surface has an arcuate surface 1*a* complementing the circumferential surface of a die wheel 2, for continuously injecting molten resin 4 from an orifice. In this embodiment, the injection nozzle 1 has a single central sprue 1*c*.

Figure 8:
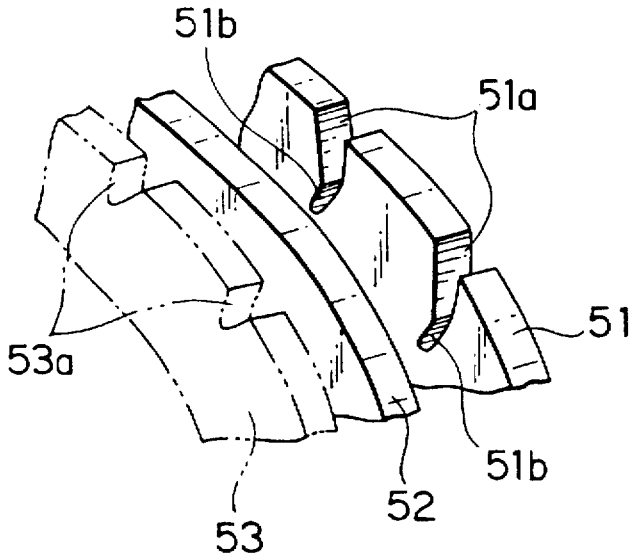
FIG. 8 is a fragmentary perspective view showing ring-shape plates as components of a die wheel used in a molded surface fastener manufacturing apparatus of this invention.

The die wheel 2 is a hollow drum having a water-cooling jacket 2*a* inside and composed of a multiplicity of non-illustrated ring-shape plates fixedly placed one over another along its axis in a laminate form. Each of the ring-shape plates in the laminate form has a multiplicity of engaging-element-primary-forming cavities 5 in the circumferential surface of the die wheel 2. In this embodiment, the engaging-element-primary-forming cavities 5 are formed by placing the ring-shape plates in such a manner that every other ring-shape plates are first ring-shape plates 51 each having a multiplicity of engaging-element-forming cutouts 51*a* at a predetermined pitch along its circumferential edge, while the remaining ring-shape plates are second ring-shape plates 52 each having front and rear flat surfaces and sandwiched between each adjacent pair of the first ring-shape plates 51. Each of the engaging-element-forming cutouts 51*a* extends, as shown in FIG. 8, straightway inwardly from the circumferential edge of the first ring-shape plate 51 at a predetermined angle 90°—θ1 with respect to a radial direction, and has an elongated triangular shape. An inner end of each engaging-element-forming cutout 51*a* is a neck 51*b* slightly bent in a substantially radial direction. Thus the die wheel 2 has a multiplicity of engaging-element-primary-forming cavities 5 partially defined one by each engaging-element-forming cutout 51*a*. The shape of this engaging-element-forming cutout 51*a* should by no means be limited to the illustrated example, and alternatively it may be an elongated parallelogram.

In an alternative form, the second ring-shape plates 52 may be substituted by third ring-shape plates 53 each having along its circumferential edge a multiplicity of triangular reinforcing-rib-forming cutouts 53*a* identical in phase with the individual engaging-element-forming cutouts 51*a*. The engaging element 12 molded on the modified die wheel 2, which is composed of the first and third ring-shape plates 51, 53, has a pair of triangular reinforcing ribs one on each of opposite sides of the stem 12*a* so that the engaging element 12 is prevented from falling flat sideways.

The die wheel 2 is driven by a non-illustrated known drive unit for rotation in a direction indicated by an arrow. Further, at a position downstream of the die wheel 2, a freely rotatable guide roller 8 is disposed, as shown in FIG. 6, for horizontally guiding a molded surface fastener 10, as a semiproduct, peeled off the circumferential surface of the die wheel 2. Further downstream of the guide roller 8, a vertical pair of take-up rollers 6, 7 to be driven at a predetermined speed of rotation for moving the molded surface fastener 10 forwardly at a predetermined speed.

At a position in a surface fastener traveling path between the guide roller 8 and the upper and lower take-up rollers 6, 7, a heat-molding roller 9 constituting essential part of the apparatus of this invention is disposed. The heat-molding roller 9 is disposed on the upper side of the surface fastener traveling path for pressing the distal end of each of engaging element blanks 4*b*, which stand in an inclined posture on the molded surface fastener 10, by a predetermined pressure so that the engaging element blank 4*b* is inclined further in the direction of its inclination. For controlling the pressure, the heat-molding roller 9 is disposed with an adjustable gap with respect to the surface fastener traveling path. In order to secure smooth movement of the surface fastener 10 and to support the surface fastener 10 from the lower side against the pressure of the heat-molding roller 9, a freely rotational belt 13 having a support plate 13*a* inside is disposed in confronting relation to the heat-molding roller 9. The speed of rotation of the heat-molding roller 9 is driven in synchronism with the speed of rotation of the take-up rollers 6, 7 by a non-illustrated synchronous drive mechanism. The synchronous drive mechanism is exemplified by a mechanical type using a known timing belt and an electronical type using a servo motor.

FIGS. 7(A), 7(B) and 7(C) show the process in which the distal end of an engaging element blank 4b of the molded surface fastener 10 is shaped into the engaging head 12b. When the semiproduct of molded surface fastener 10 fed via the guide roller 8 after molding by the die wheel 2 arrives at the heat-molding roller 9 rotating in a direction of the feed in synchronism with the speed of movement, the distal end of each engaging element blank 4b standing in an inclined posture on the molded substrate sheet 11 is pressed by a predetermined pressure. As a result, the engaging element blank 4b is inclined further in the direction of inclination and, at the same time, its distal end is melted and shaped into the engaging head 12b projecting in a direction opposite to the direction of inclination of the engaging element blank 4b. At that time, the extent of projecting of the engaging head 12b is determined by the time the distal end of the engaging element blank 4b is in contact with the heating molding roller 9, and the angle θ1–θ2 between the molded engaging head 12b and the stem 12a and the shape of the engaging head 12b are determined chiefly by the pressure and heating temperature of the heat-molding roller 9. By controlling these conditions, a wide selection is guaranteed for the shape of an engaging head 12b.

Figure 9:
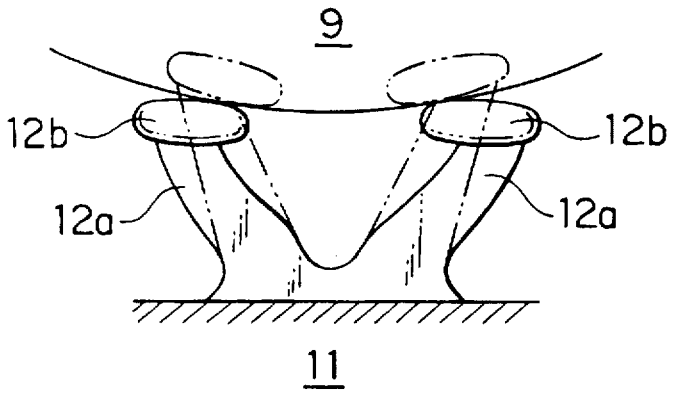
FIG. 9 is a side view showing the manner in which engaging heads of a substantially V-shape engaging element are formed by a single heat-molding roller.

The present inventor(s) discovered that this forming of the engaging head 12b by the heat-molding roller 9 is effective unexpectedly for the pair of engaging heads 12b formed at the distal ends of the stems 12a of the engaging elements 12, which stand in a substantially Y-shape or V-shape, as shown in FIGS. 4(A), 4(B), 5(A) and 5(B). Partly since the two engaging element blanks 4b are inclined in mutually opposite directions, and partly since the heat-molding roller 9 is rotated in synchronism with the speed of movement of the surface fastener 10, two engaging heads 12b can presumably be formed simultaneously. Namely, as shown in FIG. 9, two engaging heads 12b extending in opposite directions are formed as the surface fastener 10 is fed, using one heat-molding roller 9.

Figure 10:
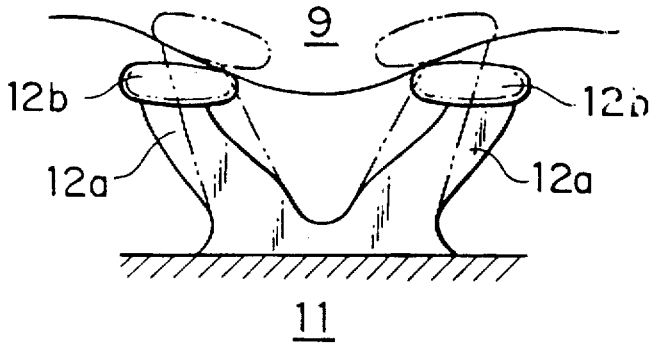
FIG. 10 is a side view showing a modified heat-molding roller suitable for use in molding a substantially V-shape or Y-shape engaging head.

FIG. 10 shows a modified heat-molding roller 9 particularly suitable for shaping the engaging head 12b formed at the distal end of each stem 12a of the pair of engaging elements 12 standing in the substantially V-shape or Y-shape. The modified heating molding roller 9 has a wave-shape circumferential surface where bulged portions and recessed portions are arranged alternately in the circumferential direction. As long as the wave-shape is such that opposed distal ends of two engaging element blanks 4b are simultaneously inclined further in opposite directions away from each other, it may be varied to meet the molding conditions.

Figure 11:
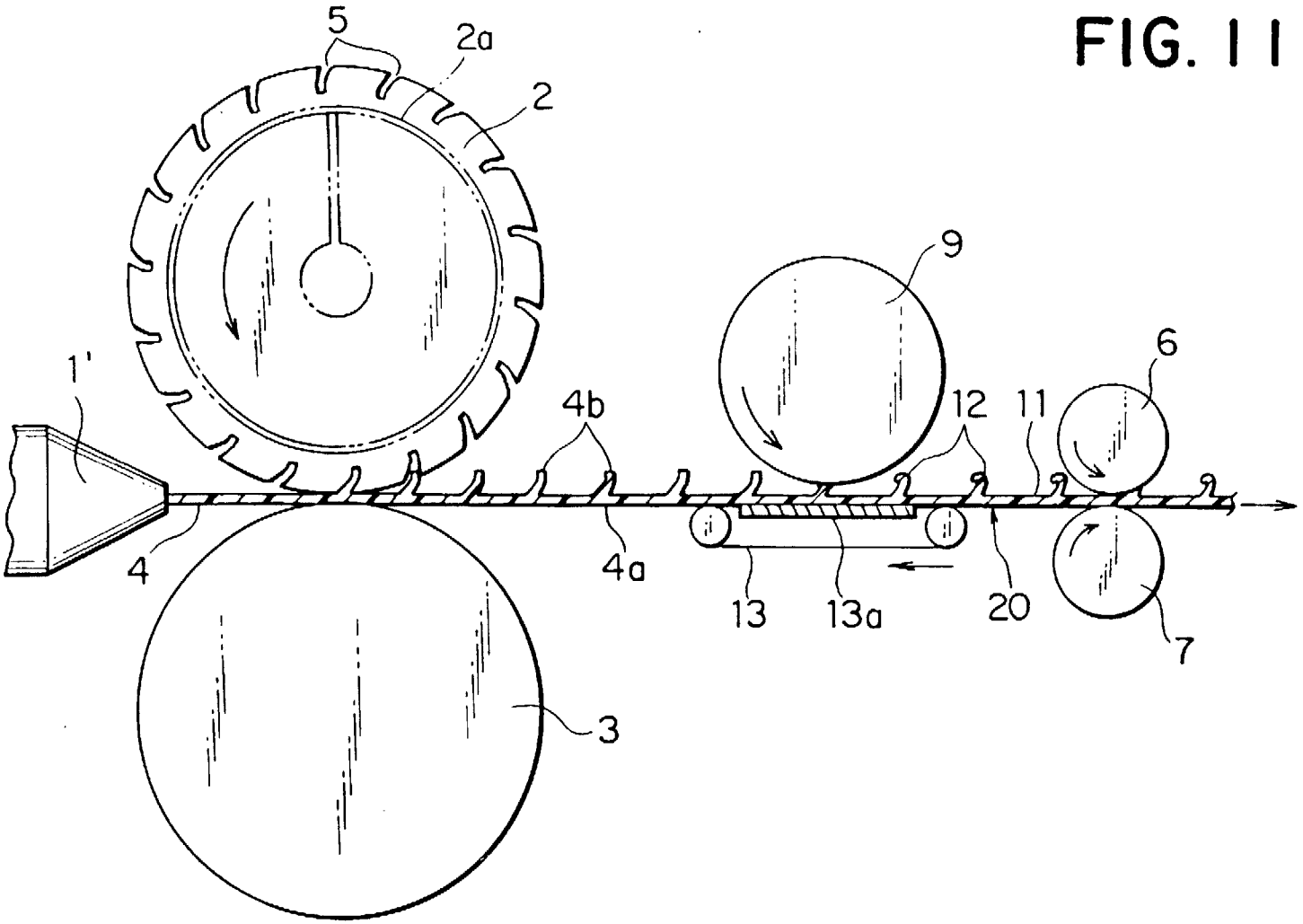
FIG. 11 is a side view showing another embodiment of the process in which a molded surface fastener is manufactured.

FIG. 11 shows another typical process in which a molded fastener is manufactured on a modified apparatus. In this modified apparatus, a pressure roller 3 driven for rotation in synchronism with the die wheel 2 is disposed in parallel to the axis of rotation of the die wheel 2, and molten resin 4 is extruded from an extrusion nozzle 1' toward a molten resin introduction port bounding between the die wheel 2 and the pressure roller 3. The remaining structure of this apparatus is substantially identical with that of the previous embodiment of FIG. 1. As the molten resin 4 is extruded to the boundary between the die wheel 2 and the pressure roller 3, a molded substrate sheet blank 4a and a multiplicity of molded engaging element blanks 4b are molded in an integral form on the circumferential surface of the die wheel 2. The molded substrate sheet blank 4a and engaging element blanks 4b are then peeled off the circumferential surface of the die wheel 2. Then distal ends of the stems 12a of the engaging elements 12 are shaped into opposed engaging heads 12b as pressed by the heating molding roller, and at the same time, the resulting molded surface fastener 10 is positively drawn by the take-up rollers 6, 7. In the embodiment of FIG. 11, the molded surface fastener 10 is shown in a straight line from the die wheel 2 to the take-up rollers 6, 7. However, it is preferable that the molded surface fastener 10 is guided by a non-illustrated guide roller to move through a predetermined angle circumferentially of the die wheel 2, similarly to what shown in FIG. 6.

As is apparent from the foregoing embodiments, according to the molded surface fastener of this invention, since the engaging element 12 has an engaging head 12b projecting from the upper end of an inclined stem 12a in a direction opposite to the direction of inclination of the stem 12a and extending at an acute angle θ2 with respect to the substrate sheet 11, it is possible to secure an improved rate of engagement with loops of a companion surface fastener and to secure an appropriate degree of resistance against separation from the loops, as compared to those of hook-shape engaging elements in a conventional molded surface fastener. Further, when a pulling force acts on the caught loop for separation, the engaging head 12b, unlike the conventional hook-shape engaging element, does not resiliently deform so that an upper end neck portion of the stem 12a would resiliently deform in a direction opposite to the direction of inclination to direct the chin of the engaging head 12b diagonally upwardly, whereupon the loop is removed off the engaging head 12b easily. Therefore, in the case where plural loops are in engagement with the same engaging head 12b, the rear end of the engaging head 12b is supported by the upper end of the stem 12a, the loops would not remain engaged with the rear end of the engaging head during separation, namely, would not assume a hanging posture so that the loops can separate smoothly from the engaging head and a durability of the engaging elements 12 is guaranteed.

Further, since the molded surface fastener of this invention can be continuously manufactured using the conventional molding apparatus with only a heat-molding roller, for example, added, it is possible to guarantee an excellent rate of production and to offer a reasonable price.

What is claimed is:

1. A surface fastener molded of synthetic resin, comprising:

a substrate sheet; and a multiplicity of engaging elements standing on a front surface of said substrate sheet;

wherein each of said engaging elements is composed of a stem rising from said substrate sheet and inclined at a predetermined angle (θ1) with respect to said front surface, and an engaging head one end of which is integrally supported on an upper end of said stem and the other end of which extends in a direction opposite to the direction of inclination of said stem in such a manner that an extension line in a direction of extension of said engaging head crosses said front surface of the substrate sheet at a predetermined acute angle (θ2).

2. A molded surface fastener according to claim 1, wherein a plurality of said engaging elements are arranged in a plurality of rows on said front surface of said substrate sheet, said stems of said engaging elements of each row being inclined in a common direction, said engaging heads of said engaging elements of each row extending in a common direction.

3. A molded surface fastener according to claim 2, wherein said stems of each adjacent pair of rows are inclined in opposite directions, and said engaging heads of each pair of rows also are inclined in opposite directions.

4. A molded surface fastener according to claim 1, wherein said stems of each adjacent pair of said engaging elements of each row are inclined in opposite directions, and said engaging heads of each adjacent pair of said engaging elements of each row are inclined in opposite directions.

5. A surface fastener molded of synthetic resin, comprising:

a substrate sheet; and a multiplicity of engaging elements standing on a front surface of said substrate sheet;

wherein a pair of said engaging elements stand in a generally V- or Y-shape and each of which is composed of a stem rising from said substrate sheet at a predetermined angle (θ1) with respect to said front surface, and an engaging head one end of which is integrally supported on an upper end of said stem and the other end of which extends in a direction opposite to inclination of said stem, said engaging heads of said pair of engaging elements extending toward each other, and an extension line of respective engaging head crosses said front surface of the substrate sheet at a predetermined acute angle (θ2).

* * * * *